US007416388B2

(12) United States Patent
Huang et al.

(10) Patent No.: US 7,416,388 B2
(45) Date of Patent: Aug. 26, 2008

(54) FAN

(75) Inventors: Wen-Shi Huang, Jungli (TW); Kuo-Cheng Lin, Taoyuan (TW); Jeng-Hung Lin, Taichung (TW); Tsu-Liang Lin, Sanchong (TW); Chih-Jen Chen, Taipei (TW); Chen-Yu Yu, Taoyuan Shien (TW); Lobato Lu, Yangmei Jen (TW); Ming-Shi Tsai, Taoyuan (TW)

(73) Assignee: Delta Electronics, Inc., Kuei San, Taoyuan Hsien (TW)

( * ) Notice: Subject to any disclaimer, the term of this patent is extended or adjusted under 35 U.S.C. 154(b) by 644 days.

(21) Appl. No.: 10/879,146

(22) Filed: Jun. 30, 2004

(65) Prior Publication Data

US 2005/0002808 A1 Jan. 6, 2005

(30) Foreign Application Priority Data

Jul. 2, 2003 (TW) ..... 92118028 A
Jul. 2, 2003 (TW) ..... 92118029 A

(51) Int. Cl.
*F04D 29/40* (2006.01)

(52) U.S. Cl. ..... 415/214.1; 416/244 R; 310/67 R

(58) Field of Classification Search ..... 415/206, 415/214.1, 220, 223; 416/170 R, 240 R, 416/244 R; 310/67 R, 90
See application file for complete search history.

(56) References Cited

U.S. PATENT DOCUMENTS 5,363,003 A * 11/1994 Harada et al. ..... 310/67 R
5,871,335 A * 2/1999 Bartlett ..... 416/244 R
6,071,078 A 6/2000 Schlegel et al.
6,183,214 B1 2/2001 Ko
6,322,232 B1 11/2001 Oliver
6,493,225 B2 12/2002 Chuang et al.
7,140,837 B2 * 11/2006 Ku et al. ..... 415/121.2
2002/0060900 A1 5/2002 Qiu
2002/0067597 A1 6/2002 Chuang et al.
2002/0122733 A1 * 9/2002 Lin et al. ..... 417/423.5
2005/0052089 A1 * 3/2005 Horng et al. ..... 310/90

FOREIGN PATENT DOCUMENTS

CN 2429665 5/2001
CN 1369649 8/2002
JP 58-165298 11/1983
JP 62-185471 U 8/1987
JP 62-180699 11/1987
JP 6-275750 A 9/1994
JP 3029381 7/1996

(Continued)

*Primary Examiner*—Edward Look
*Assistant Examiner*—Nathaniel Wiehe
(74) *Attorney, Agent, or Firm*—Muncy, Geissler, Olds & Lowe, PLLC

(57) ABSTRACT

A fan is disclosed for use in a system, and the system has at least one connection structure. The fan is mainly composed of an impeller and a base, and the impeller is connected to the base. The impeller at least has a hub, a plurality of blades and a driver. The base has at least one engaging member, and the engaging member is corresponding to the connection structure. Further, the fan is fixed on the system by connecting the engaging member and the connection structure together.

30 Claims, 7 Drawing Sheets

FOREIGN PATENT DOCUMENTS

| | | | |
|---|---|---|---|
| JP | 10-98847 | | 4/1998 |
| JP | 10-285872 | A | 10/1998 |
| JP | 2000-179490 | A | 6/2000 |
| JP | 2002-39099 | A | 2/2002 |
| JP | 2003-56498 | | 2/2003 |
| KR | 2001-18797 | | 3/2001 |
| TW | 523652 | | 3/2003 |

* cited by examiner

110

120

300c

300d

FAN

This Non-provisional application claims priority under 35 U.S.C. § 119(a) on Patent Application No(s). 092118028 and 092118029 filed in Taiwan on Jul. 2, 2003, the entire contents of which are hereby incorporated by reference.

FIELD OF THE INVENTION

The present invention relates to a fan and a fan fixer thereof, and more particularly, to the fan and the fan fixer thereof having the features of low noise level; low cost; and high heat-dissipating capability.

BACKGROUND OF THE INVENTION

In the existing heat source system, a fan is one of the most commonly used heat-dissipating apparatuses. The conventional fan structure is composed of a housing, a hub, blades and a motor component, wherein screw holes are formed on four corners of the housing. When the heat source system uses the aforementioned fan structure as its heat-dissipating device, four screw fastening holes corresponding to the screw holes of the fan housing are generally formed on the heat source system, and then four pieces of screws are inserted into the screw fastening holes of the heat source system and into the corresponding screw holes of the fan housing, so as to fix the fan on the heat source system.

However, the assembly of the heat source system and the fan needs to use quite a lot of screws, and the expense of molding tools and material used for developing the housing portion in the conventional fan structure also occupies quite a large portion of the total fabrication cost of the fan, so that the cost for fabricating and assembling the conventional fan cannot be further lowered.

Further, when the conventional fan is in operation, big noise is frequently generated due to the air resistance therein. Although it is possible to lower slightly the noise level of the conventional fan by modifying the shape of the fan housing, yet the noise level thereof still cannot be lowered effectively.

Moreover, the air volume provided by the conventional fan is restricted by both the opening size of the fan housing and the dead space portion between the heat source system and the fan housing, so that the heat generated in the heat source system fails to be totally removed. Hence, with respect to the heat source system, the conventional fan cannot dissipate the heat completely therein, so that the problem of residual heat still remains.

SUMMARY OF THE INVENTION

Hence, for resolving the above-identified problems, the present invention provides a fan for greatly reducing the fabrication cost and time.

The present invention further provides a fan for greatly enhancing the convenience for dismantling the fan and the heat source system.

The present invention further provides a no-fame fan for lowering the noise level while the fan is in operation.

The present invention further provides a fan for greatly promoting the heat-dissipating efficiency.

The present invention further provides a fan for greatly lowering the production cost.

The present invention further provides a fan for greatly shortening the time for dismantling the fan and the heat source system.

As such, the present invention provides a fan suitable for use in a system, and the system has at least one connection structure, and the fan includes an impeller, a driver and a base. The impeller at least has a hub and blades, and the impeller and the driver are connected to the base. The base has at least one engaging member, and the engaging member is corresponding to the connection structure. The fan is fixed on the system by connecting the engaging member and the connection structure. The fan has a switch element to control the connection of the engaging member and the connection structure. The engaging member and the connection structure are male/female connector, and the relationship between the connection structure and the system can be monolithically formed or separated. The fan further comprises the feature that the base is connected to the system by a method such as a fastening method, an engaging method, an adhering method, or combinations thereof. The material of the base or the connection structure is such as metal material, paper material, elastic fiberglass, plastic material, or combinations thereof. The connection structure is connected to the system by a method such as a fastening method, an engaging method, an adhering method, or combinations thereof. The fan further includes an outer frame, and the outer frame surrounds the impeller, and the outer frame can be formed on the system, monolithically formed or separately. The outer frame has a top side opening, a medially side opening, and a bottom side opening. The outer frame has at least one side-wall, and the side-wall can be continuous or discontinuous. The type of the blades can be flat-plate type, a multi-wings type, a centrifugal type, an axial-flow type, or combinations thereof. The fan further includes a buffer structure, and the buffer structure is located between the fan and the system.

The present invention further provides a fan composed of an impeller, a driver, a switch element, an outer frame, a base and at least one connection structure. The impeller at least has a hub and blades, and the outer frame surrounds the impeller. The impeller is connected to the base, and the base has at least one engaging member. The connection structure is connected to the outer frame, and the connection structure corresponds to the engaging member.

The present invention further provides a fan composed of an impeller, a driver, a switch element and a base. The impeller at least has a hub and blades. The impeller is connected to the base, and the base has at least one engaging member.

To sum up, since the fan of the present invention has the fixer that can be rigidly fixed on the system, and the system merely needs to be implemented with the fixing portion matching the fixing portion of the fan, so as to fix the fan of the present invention on the system. Hence, the present invention does not need to use the fasten elements such as screws or merely needs to use relatively few screws to complete the fixing motion, thus greatly reducing the cost and the production time.

Since the fan of the present invention is a frameless type, the usage amount of the material forming the fan can be greatly reduced, thus greatly reducing the manufacturing time and cost.

The fan of the present invention can use the adjustment of the switch element to easily connect or separate the fan and the system, so that the convenience for dismantling the fan and the system can be enhanced, and the time for dismantling the fan and the system can be shortened.

Moreover, the fan of the present invention does not have the housing structure which will increase air resistance and noise level, so that the noise level of the fan while in operation can be greatly lowered.

Further, since the air-inlet environment for the fan of the present invention covers the entire system's portion of which the heat is desired to be dissipated, the fan of the present invention can obtain the maximum heat-dissipating efficiency, and thus the problem of residual heat can be prevented.

For clearly explaining the objects, features and advantages of the present invention, a preferred embodiment with accompanying figures is described in detail hereinafter.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
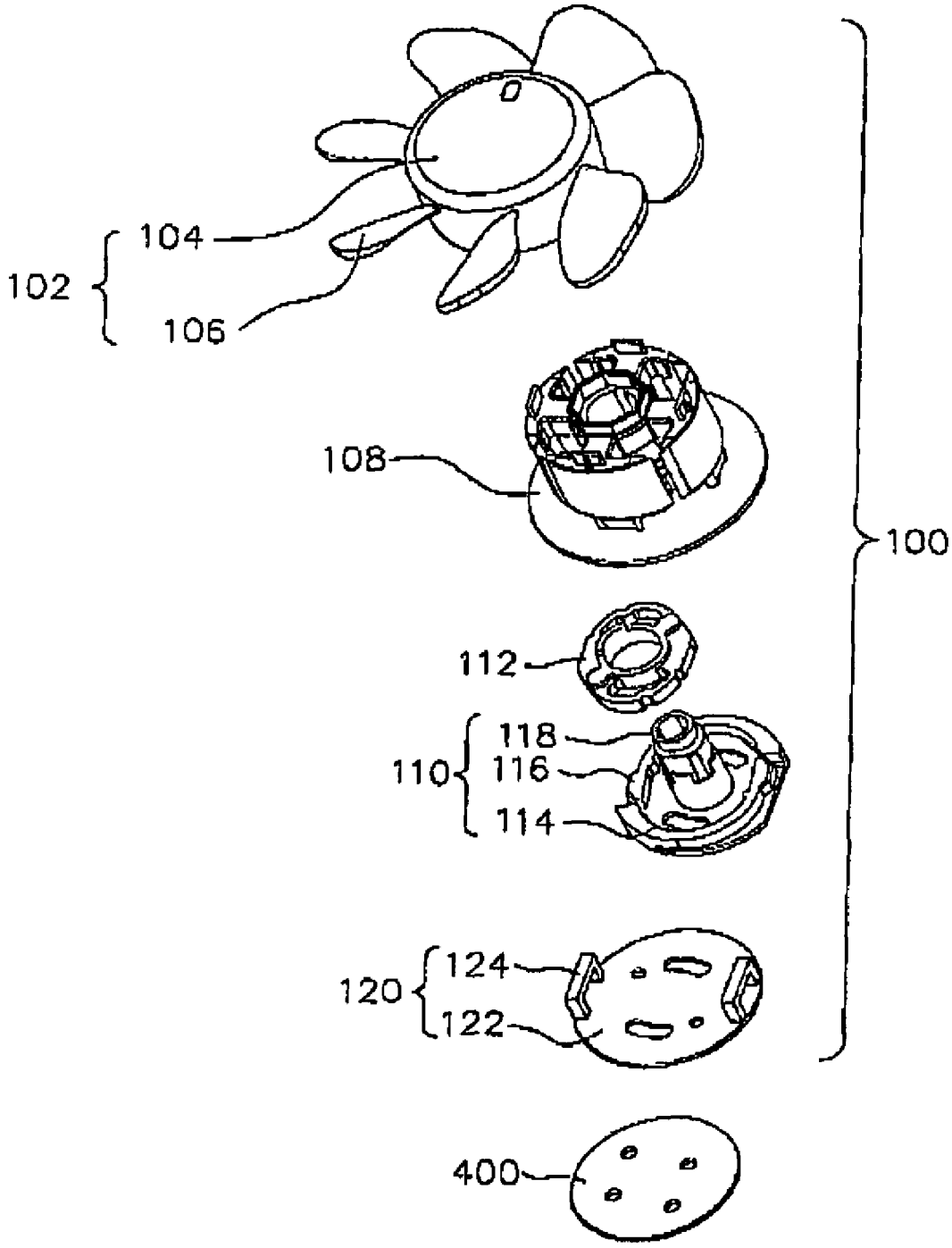
FIG. 1 is a schematic explosive view illustrating a fan according to a preferred embodiment of the present invention.
Figure 2:
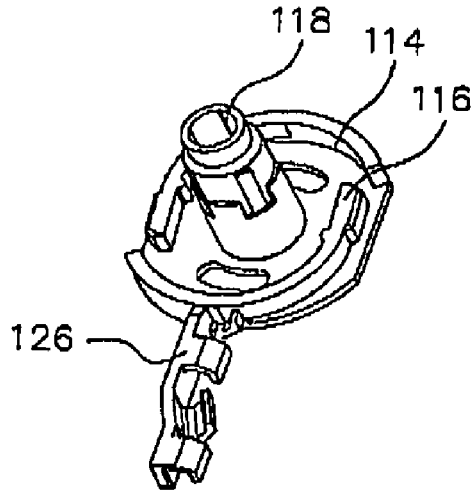
FIG. 2 is a schematic view illustrating a fixer of the fan according to the preferred embodiment of the present invention.
Figure 3:
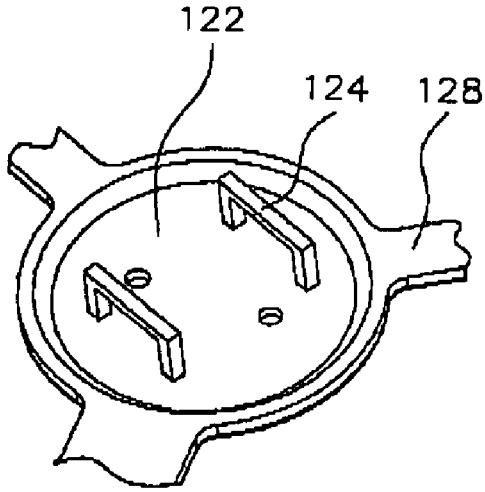
FIG. 3 is a schematic view illustrating a base according to the preferred embodiment of the present invention.
Figure 4:
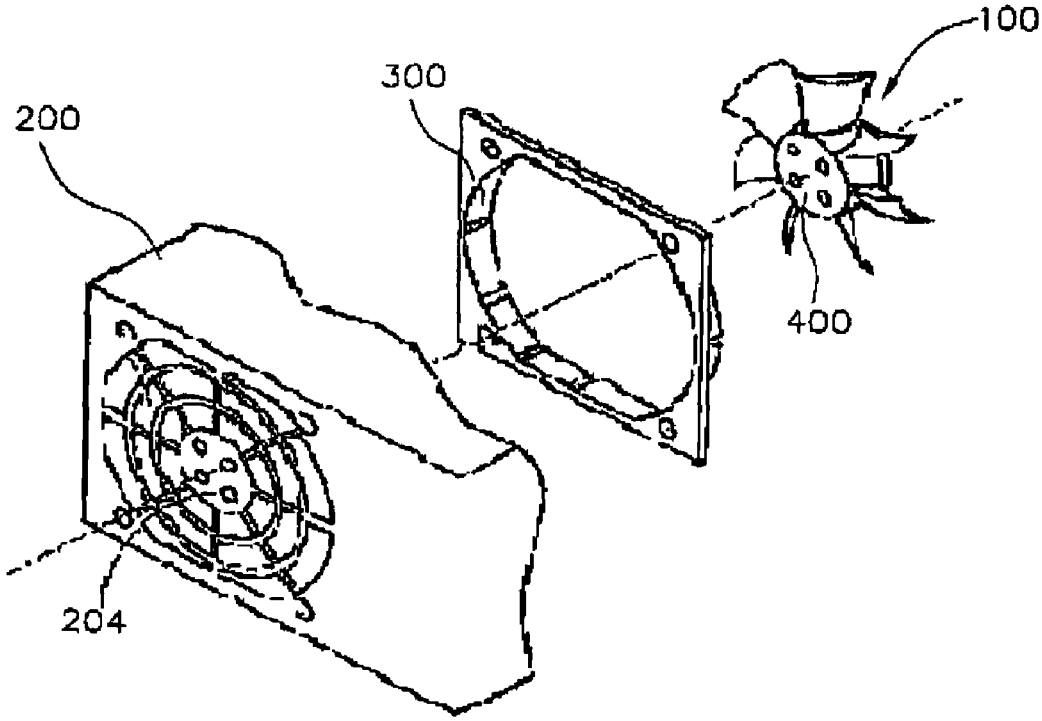
FIG. 4 is a schematic explosive view illustrating the fan and a device according to the preferred embodiment of the present invention.

FIG. 1 is a schematic explosive view illustrating a fan 100 without an outer frame according to a preferred embodiment of the present invention. FIG. 2 is a schematic view illustrating a base 110 of the fan 100 according to the preferred embodiment of the present invention. FIG. 3 is a schematic view illustrating a connection structure 120 according to the preferred embodiment of the present invention. FIG. 4 is a schematic explosive view illustrating the fan 100 and a system 200 according to the preferred embodiment of the present invention. Referring simultaneously to FIG. 1 to FIG. 4, a fan 100 comprises an impeller 102, and a base 110 with an engaging member 116, wherein the fan 100 is fixed on a system 200 by connecting the engaging member 116 to a connection structure 120 on the system 200. The system 200 can be, for example, a power supplier, a computer, a server, a projector, a projection TV, an air expeller or a blower.

The impeller 102 comprises a hub 104 and a plurality of blades 106, and is driven by a driver 108.

Figure 5:
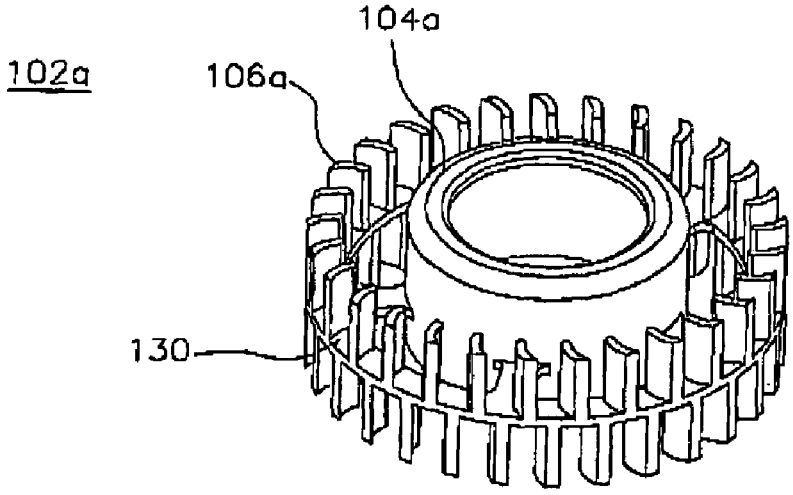
FIG. 5 is a schematic view illustrating blades of the fan of the present invention.

The blades 106 are fixed around the outer side-wall of the hub 104. The number and shape of the blades 106 can be properly adjusted in accordance with the actual needs. For example, the type of the blades 106 can be an axial-flow type, a centrifugal type, a flat-plate type, a multi-wings type, or combinations thereof. Such as shown in FIG. 5, a impeller 102*a* is a blower comprised a hub 104*a*, a rib 130 surrounding the hub 104*a*, a plurality of blades 106*a* located on the rib 130.

The driver 108 has a driving circuit and magnetic poles for driving the fan 100. The magnetic poles can be such as N-S poles of the stator, wherein the number of the magnetic poles corresponds to that of the aforementioned magnetic material layer.

The base 110 has a main body 114, a fixing portion 118, and an engaging member 116. The main body 114 is used to load the impeller 102. The shape of the main body 114 can be a circle, an oval, a polygon, an irregular shape or any other regular shape. The fixing portion 118 protrudes from the surface of the main body 114 for positioning and fixing the impeller 102. The shape of the fixing portion 118 can be a tube shape or a column shape. For example, the base 110 can be made by a metal material, a paper material, an elastic fiberglass, a plastic material, or combinations thereof. The metal material can be gold, silver, iron, aluminum, titanium or the alloys thereof.

The engaging member 116 comprises an arm and an engaging portion. The engaging portion corresponds to the connection structure 120, and the arm is movable. When the arm is moved, the engaging portion and the connection structure 120 can be controlled to be connected or separated. If the engaging portion of the engaging member 116 is connected to the connection structure 120, the impeller 102 or the fan 100 could be fixed on the system 200. For example, the engaging portion and the connection structure 120 are male/female connector. The type of the engaging portion is selected from the group consisting of an arrow, an inverted hook, a column, an irregular bump, a claw, a cavity, an opening, a hole, or combinations thereof.

Additionally, the fan 100 further comprises at least one switch element 112, and the switch element 112 separable from the base 110 and the connection structure 120 is used for easily controlling the engaging member 116 and the connection structure 120 to be connected or separated. The shape of the switch element 112 can be an oval, a polygon having shorter and longer sides, an irregular shape having shorter and longer sides, or a regular shape having shorter and longer sides. For example, the switch element 112 is in an oval shape and is located in a depression portion of the base 110, and the engaging member 116 is a portion of the sidewall of the depression portion. If the longer side of the switch element 112 does not contact the engaging member 116 at this time, (i.e. the engaging member 116 and the connection structure 120 are separated), then the switch element 112 is rotated so as to force the longer side of the switch element 112 to tightly resist the engaging member 116, so that the engaging member 116 and the connection structure 120 will be engaged. Consequently, the base 110 and the impeller 102 will be fixed on the connection structure 120, and the fan 100 will be fixed on the system 200. While the switch element 112 is rotated again and the longer side of the switch element 112 is moved away from the engaging member 116, the engaging member 116 and the connection structure 120 will be separated. Consequently, the base 110 and the impeller 102 will be separated from the connection structure 120, and the fan will be separated from the system 200.

Additionally, the base 110 further comprises at least one holding portion 126 as shown in FIG. 2. The holding portion 126 corresponds to a holding portion 128 of the connection structure 120 as shown in FIG. 3. When the holding portion 126 connects to the holding portion 128, the connection between the base 110, the connection structure 120, and the system 200 (as shown in FIG. 4) will be stronger. For example, the holding portion 126 is an engaging structure or a buckling structure. The holding portion 126 can be used for not only reinforcing the combination force between the base 110, the connection structure 120, and the system 200, but also clamping the driver 108.

The base 110 also connects to the system 200 by another method selected from the group consisting of a fastening method, an engaging method, an adhering method, and combinations thereof. When the base 110 and the system 200 are connected by the connection between the engaging member 116 and the connection structure 120, using the other method will increase the connection between the base 110 and the system 200.

The connection structure 120 has a main body 122 and a connection portion 124. The connection portion 124 is formed on the main body 122 corresponding to the engaging portion. The type of the connection portion 124 is selected from the group consisting of an arrow, an inverted hook, a column, an irregular bump, a claw, a cavity, an opening, a hole, or combinations thereof. The shape of the main body 122 can be a circle, an oval, a polygon, an irregular shape or any other regular shape. The relationship between connection structure 120 and the system 200 is monolithically formed or separated. For example, the connection structure 120 can be made by a metal material, a paper material, an elastic fiberglass, a plastic material, or combinations thereof. The metal material can be gold, silver, iron, aluminum, titanium or the alloys thereof.

The connection method for the connection structure 120 and the system 200 is selected from the group consisting of a fastening method, an engaging method, an adhering method, and combinations thereof. The connection structure 120 can also be formed on a buffer structure 400, and then the buffer structure 400 connects to the system 200.

Additionally, the fan 100 further comprises an outer frame 300, and the outer frame 300 surrounds the impeller 102. The outer frame 300 is connected to the system 200 or the connection structure 120, and the relationship between outer frame 300 and the connection structure 120 and/or the system 200 is monolithically formed or separated. The outer frame 300 has at least one side-wall, and the side-wall is continuous or discontinuous (shown in FIG. 4). The material forming the frame 300 can be, for example, metal material, paper material, elastic fiberglass and plastic material. Specifically speaking, the metal material can be, for example, gold, silver, copper, iron, aluminum, titanium or the alloys thereof. The plastic material can be, for example, polybutyleneterephthalate (PBT) containing 30% fiberglass.

Figure 6A:
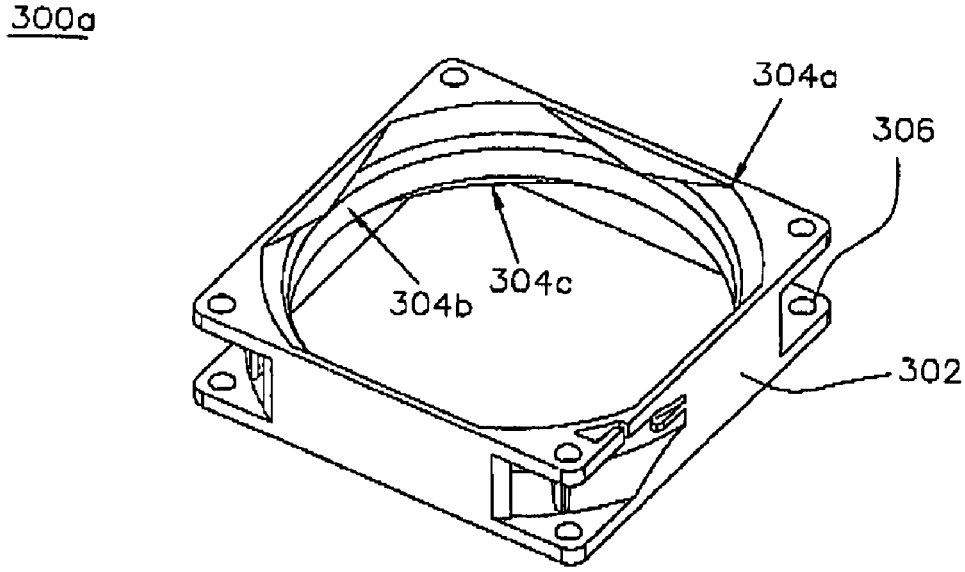
FIG. 6A to FIG. 6F are schematic views illustrating diversion structures of the fan of the present invention.
Figure 6B:
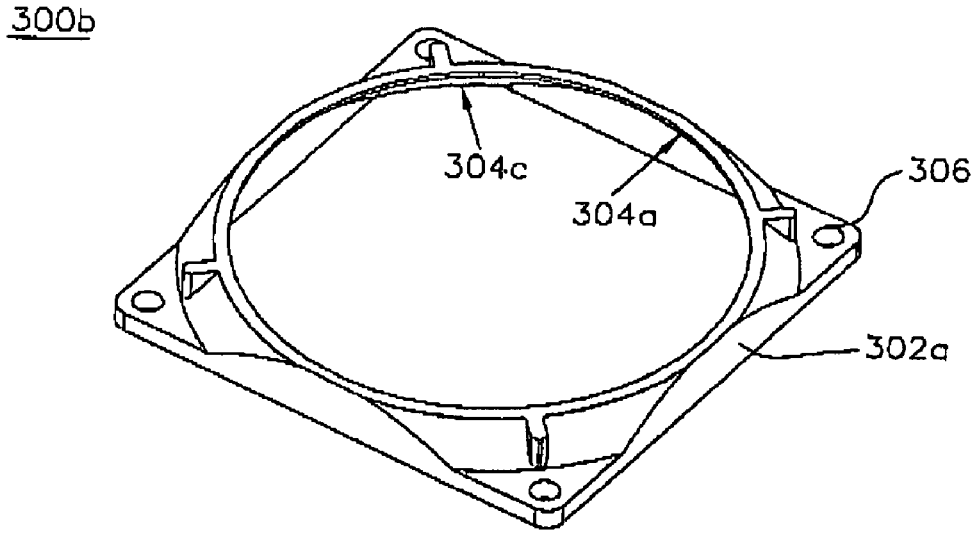
Figure 6C:
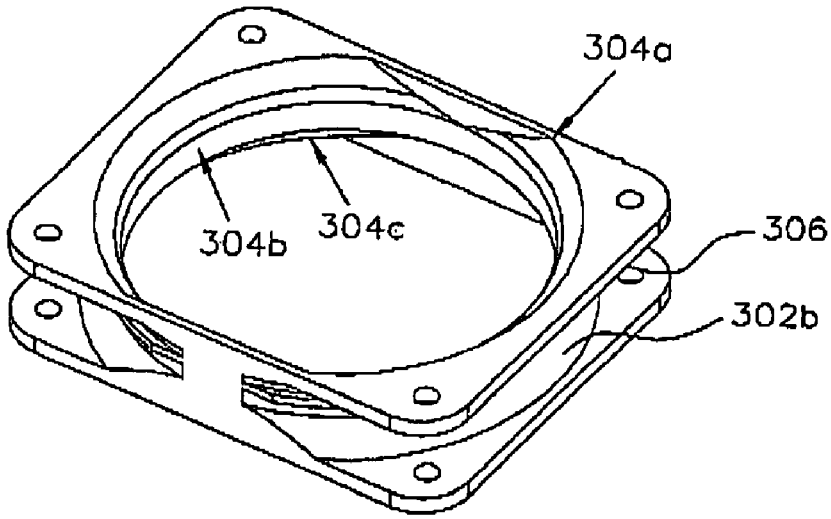
Figure 6D:
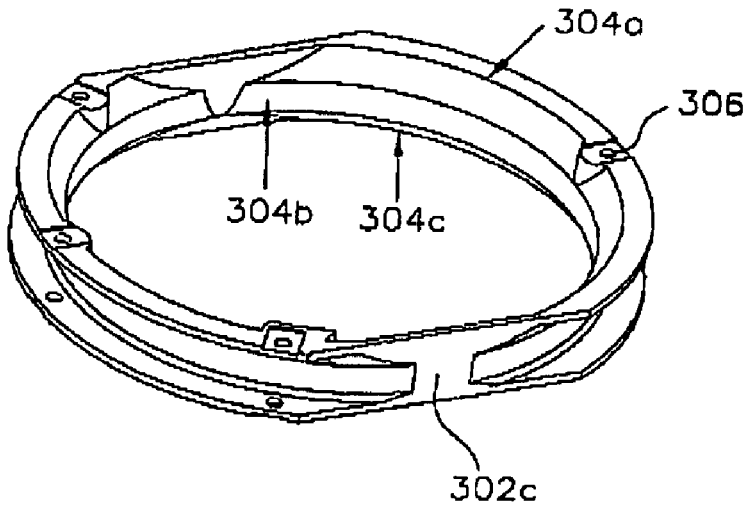
Figure 6E:
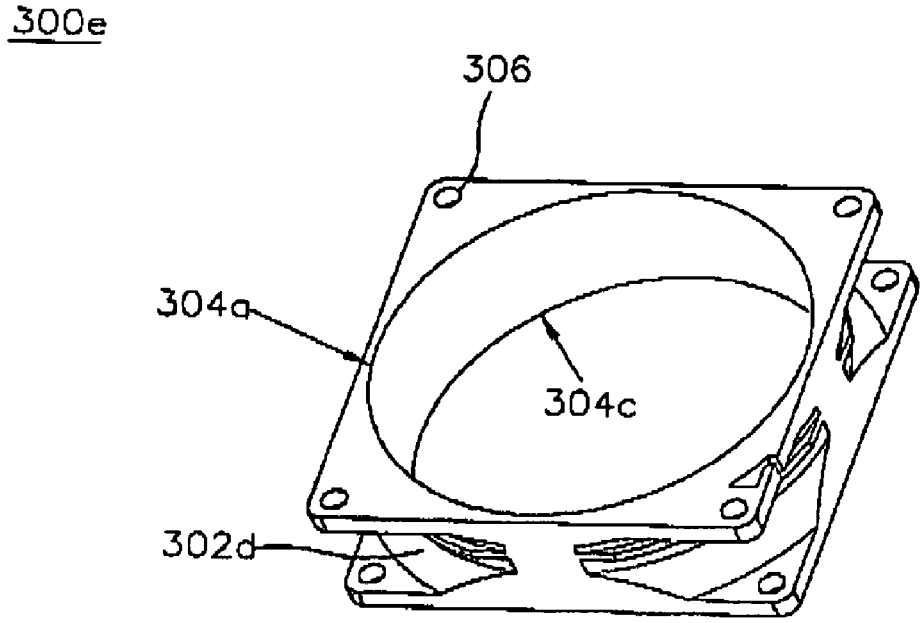
Figure 6F:
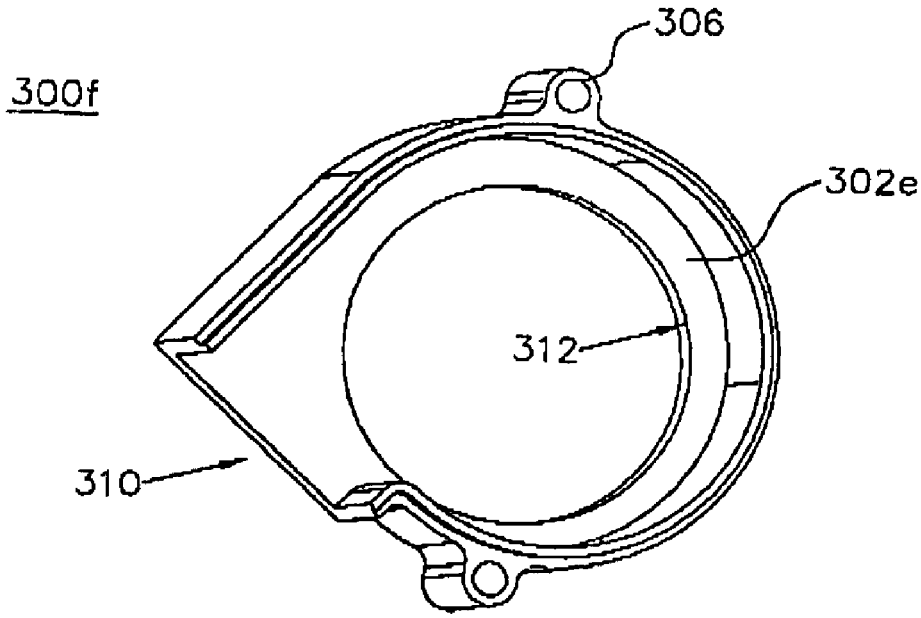

The outer frame can have a top side opening, a medially side opening, and a bottom side opening, and the shapes of the openings are shown as FIGS. 6A~6E. For example, the outer frame can be a centrifugal type or an axial-flow type. As shown in FIG. 6A, the outer frame can be an outer frame 300*a* with a square frame 302, and the size of a medial side opening 304*b* is smaller than or the same as a top side opening 304*a* and a bottom side opening 304*c*. As shown in FIG. 6B, the outer frame can be an outer frame 300*b* with a square frame 302*a*, and the size of a top side opening 304*a* is smaller than or the same as a bottom side opening 304*c*. As shown in FIG. 6C, the outer frame can be an outer frame 300*c* with a rectangular frame 302*b* and the size of a medial side opening 304*b* is smaller than or the same as a top side opening 304*a* and a bottom side opening 304*c*. As shown in FIG. 6D, the outer frame can be an outer frame 300*d* with a circle frame 302*c*, and the size of a medial side opening 304*b* is smaller than or the same as a top side opening 304*a* and a bottom side opening 304*c*. As shown in FIG. 6E, the outer frame can be an outer frame 300*e* with a square frame 302*d*, and the size of a top side opening 304*a* is equal to a bottom side opening 304*c*. As shown in FIG. 6F, the outer frame can be an outer frame 300*f* with a blower type frame 302*e*, or any other structure having the capability of guiding airflow. Furthermore, the outer frame 300*f* has at least one axial inlet 312 and at least one side outlet 310.

The outer frame 300~300*f* further comprise a connecting hole 306 for connecting the outer frame and the system by an method selected from the group consisting of a fastening method, an engaging method, an adhering method, one-single modeling method, and combinations thereof.

Figure 7:
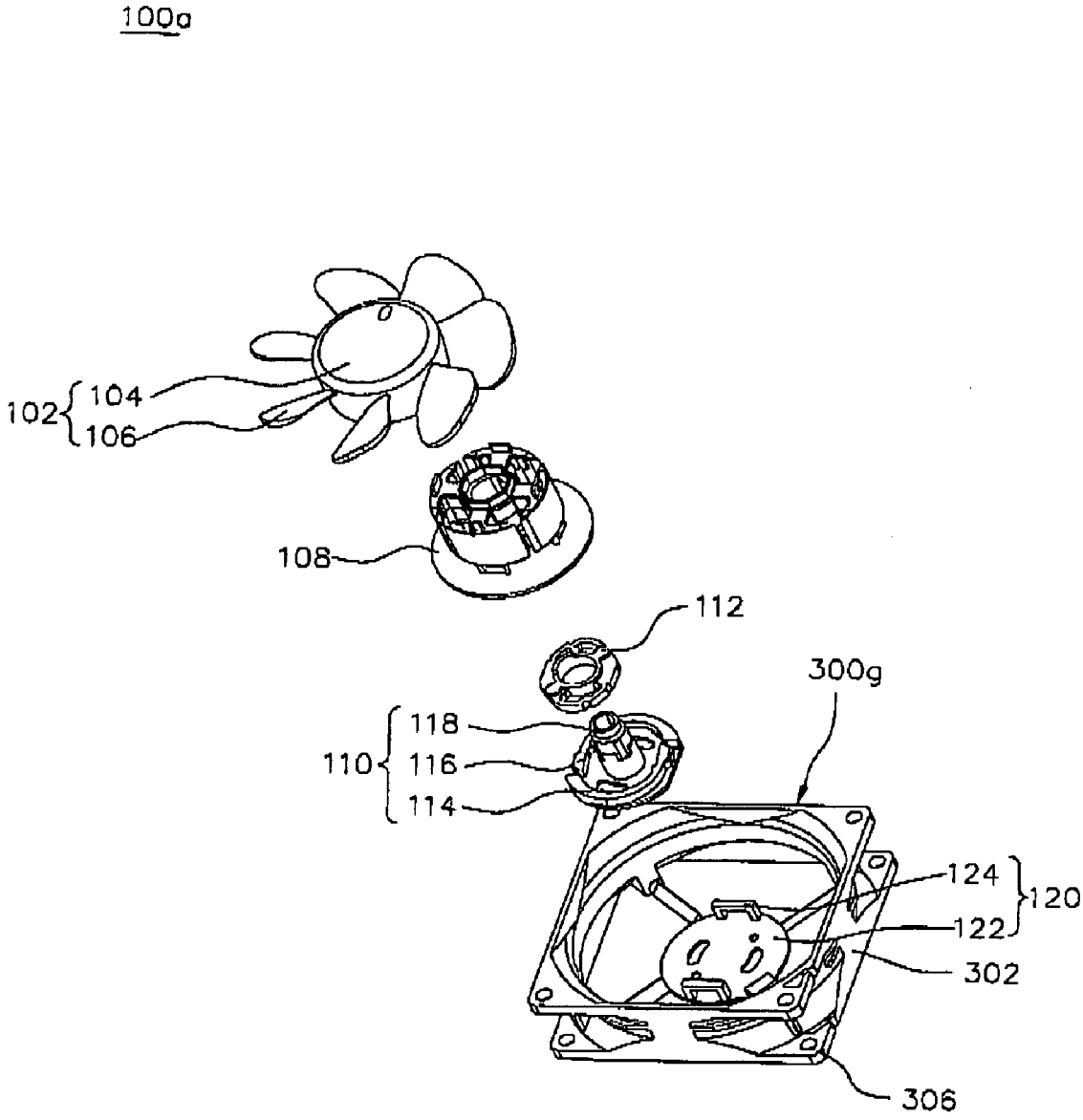
FIG. 7 is a schematic diagram showing the combination of the base and the diversion structure according to the present invention.

When the outer frame connects to the connection structure, the outer frame can be a fan frame. Referring to FIG. 7, a fan 100*a* comprises the impeller 102, the driver 108, the switch element 112, the base 110 with the engaging member 116, and a fan frame 300*g* surrounding the impeller 102, wherein the impeller 102 is fixed on the fan frame 300*g* by connecting the engaging member 116 to a connection structure 120 on the fan frame 300*g*. The fan frame 300*g* comprises the square frame 302, the connection structure 120, and the connecting hole 306. The fan 100*a* can be a combinatorial fan, or the fan 100*a* can be properly adjusted in accordance with the actual needs to change the impeller 102 or 102*a* in accordance with the frame 302 or 302*a*-302*e*.

Further, the material forming the connection structure of the system can be, for example, gold, silver, copper, iron, aluminum, titanium or the alloys thereof. Moreover, although the present invention uses the fan directly connected to the system as an example for explanation, the present invention is not limited thereto, wherein, such as shown in FIG. 4, the fan 100 of the present invention can be first connected to a buffer structure 400, and then the buffer structure 400 is fixed on the system. The buffer structure 400 and the device (the system 200) can be connected by, for example, insetting, fastening or adhering.

Hereinafter, an embodiment is used for explaining in detail the fan of the present invention, and the method of jointing or separating the system and the fan. Please refer to FIGS. 1 and 4. In this embodiment, the system 200 can be, for example, the housing of a power supplier, and the housing has the net plate 204 and the connection structure 120. The connection structure 120 corresponds to the engaging member 116 of the base 110.

At first, the impeller 102 is connected to the base 110 for forming the fan 100. Thereafter, the switch element 112 is adjusted to an open state, and the engaging member 116 is putted near the connection structure 120 of the system 200. Then, the switch element 112 is changed to a close state, and the engaging member 116 is fixed to the connection structure 120 by the pushing force of the switch element 112. In this time, the fan 100 is fixed to the system 200.

When the state of the switch element 112 is changed to an open state, the pushing force of the switch element 112 will be removed to separate the engaging member 116 and the connection structure 120. In this time, the fan 100 is separated from the system 200.

Further, the method for connecting the fan 100 to the system 200 is not limited to those described above, and can be achieved by interconnecting the base 110 and the connection structure 120. For example, the impeller 102 is fixed on the base 110, and then the base 110 is disposed on one side of the system 200 (i.e. on one side of the net plate 204), and thereafter, the base 110 and the connection structure 120 are connected. The system 200 is connected by the base 110 and the connection structure 120 so as to be combined with the fan 100. The connecting method is, for example, to connect the engaging member 116 of the base 110 to the connection portion 124 of the connection structure 120. Then, the system 200 is securely connected by the base 110 and the connection structure 120, and the fan 100 is securely connected to the system 200.

Further, the holding portion 126 (as shown in FIG. 2) of the fan 100 can be rigidly connected correspondingly to the supporting stripes of the net plate 204 so as to fix the fan 100 on the system 200.

The fan and the system can also be assembled by screwing or adhering the fan of the present invention to the fixing plate, and then the fixing plate is fixed on the system by fastening with screws, insetting or adhering.

Although the fan is used as an example for explaining the fan fixer of the present invention, the present invention is not limited thereto, wherein the fan of the present invention as a fixer with the diversion structure. With the application of the present invention, the fan having the diversion structure can be easily connected to the device without using any fastening elements such as screws.

To sum up, since the fan of the present invention has the fixer that can be rigidly fixed on the system, and the system merely needs to be implemented with the fixing portion matching the fixing portion of the fan, so as to fix the fan of the present invention on the system. Hence, the present invention does not need to use the fasten elements such as screws or merely needs to use relatively few screws to complete the fixing motion, thus greatly reducing the cost and the production time.

Since the fan of the present invention is a frameless type, the usage amount of the material forming the fan can be greatly reduced, thus greatly reducing the manufacturing time and cost.

The fan of the present invention can use the adjustment of the switch element to easily connect or separate the fan and the system, so that the convenience for dismantling the fan and the system can be enhanced, and the time for dismantling the fan and the system can be shortened.

Moreover, the fan of the present invention does not have the housing structure which will increase air resistance and noise level, so that the noise level of the fan, while in operation, can be greatly lowered.

Further, since the air-inlet environment for the fan of the present invention covers the entire system's portion which the heat is desired to be dissipated, the fan of the present invention can obtain the maximum heat-dissipating efficiency, and thus the problem of residual heat can be prevented.

As is understood by a person skilled in the art, the foregoing preferred embodiments of the present invention are illustrated of the present invention rather than limiting of the present invention. It is intended to cover various modifications and similar arrangements included within the spirit and scope of the appended claims, the scope of which should be accorded the broadest interpretation so as to encompass all such modifications and similar structures.

What is claimed is:

1. A fan, suitable for use in a system having at least one connection structure, comprising:

an impeller having a hub and a plurality of blades;

a base used for mounting said impeller thereon and having at least one engaging member corresponding to said connection structure; and a switch element separable from said base and said connection structure, and used to control the connection of said engaging member and said connection structure;

wherein said fan is fixed on said system by connecting said engaging member and said connection structure.

2. The fan of claim 1, wherein said engaging member and said connection structure are male/female connector.

3. The fan of claim 1, wherein the relationship between said connection structure and said system is monolithically formed or separated.

4. The fan of claim 1, wherein said base is connected to said system by fastening, engaging, adhering or a combination thereof.

5. The fan of claim 1, wherein the material of said base or said connection structure is selected from the group consisting of metal material, paper material, elastic fiberglass, plastic material, and combinations thereof.

6. The fan of claim 1, wherein said connection structure is connected to said system by fastening, engaging, adhering or a combination thereof.

7. The fan of claim 1, further comprising an outer frame, wherein said outer frame surrounds said impeller.

8. The fan of claim 7, wherein said outer frame is formed on the system monolithically or separately.

9. The fan of claim 7, wherein said outer frame has a top side opening, a medial side opening, and a bottom side opening.

10. The fan of claim 7, wherein said outer frame has at least one side-wall, wherein said side-wall is continuous or discontinuous.

11. The fan of claim 1, wherein the type of said blades is a flat-plate type, a multi-wings type, a centrifugal type, an axial-flow type, or a combination thereof.

12. The fan of claim 1, further comprising a buffer structure, wherein said buffer structure is between said fan and said system.

13. The fan of claim 1, wherein the base has a first holding portion, and the system has a second holding portion corresponding to the first holding portion.

14. A fan, comprising:

an impeller having a hub and a plurality of blades;

an outer frame surrounding said impeller;

a base used for mounting said impeller thereon and having at least one engaging member;

at least one connection structure, wherein said connection structure is connected to said outer frame and is corresponding to said engaging member; and a switch element separable from said base and said connection structure, and used to control the connection of said engaging member and said connection structure.

15. The fan of claim 14, wherein said engaging member and said connection structure are male/female connector.

16. The fan of claim 14, wherein said base is connected to said connection structure by fastening, engaging, adhering or a combination thereof.

17. The fan of claim 14, wherein the material of said base or said connection structure is selected from metal material, paper material, elastic fiberglass, plastic material or a combination thereof.

18. The fan of claim 14, wherein said outer frame and said connection structure is monolithically formed or separated.

19. The fan of claim 14, wherein said outer frame has a top side opening, a medial side opening, and a bottom side opening.

20. The fan of claim 14, wherein said outer frame has at least one side-wall, and said side-wall is continuous or discontinuous.

21. The fan of claim 14, wherein the type of said blades is a flat-plate type, a multi-wings type, a centrifugal type, an axial-flow type or a combination thereof.

22. The fan of claim 14, wherein the base has a first holding portion; and the outer frame has a second holding portion corresponding to the first holding portion.

23. A fan, comprising:

an impeller having a hub and a plurality of blades;

a base used for mounting said impeller thereon and having at least one engaging member;

at least one connection structure positioned corresponding to said engaging member; and a switch element separable from said base and said connection structure, and used to control the connection of said engaging member and said connection structure.

24. The fan of claim 23, wherein said engaging member and said connection structure are male/female connector.

25. The fan of claim 23, wherein said base is connected to said connection structure by fastening, engaging, adhering or a combination thereof.

26. The fan of claim 23, wherein the material of said base is selected from the group consisting of metal material, paper material, elastic fiberglass, plastic material, and combinations thereof.

27. The fan of claim 23, further comprising an outer frame surrounding said impeller.

28. The fan of claim 27, wherein said outer frame has a top side opening, a medial side opening, and a bottom side opening.

29. The fan of claim 27, wherein said outer frame has at least one side-wall, and said side-wall is continuous or discontinuous.

30. The fan of claim 23, wherein the type of said blades is a flat-plate type, a multi-wings type, a centrifugal type, an axial-flow type or a combination thereof.

* * * * *